US007288761B2

(12) United States Patent
Collings

(10) Patent No.: US 7,288,761 B2
(45) Date of Patent: Oct. 30, 2007

(54) SYSTEM AND METHOD FOR TRAPPING IONS

(75) Inventor: Bruce Andrew Collings, Bradford (CA)

(73) Assignee: MDS Analytical Technologies, a business unit of MDS Inc., Concord (CA)

( * ) Notice: Subject to any disclaimer, the term of this patent is extended or adjusted under 35 U.S.C. 154(b) by 336 days.

(21) Appl. No.: 11/135,426

(22) Filed: May 24, 2005

(65) Prior Publication Data

US 2005/0258362 A1 Nov. 24, 2005

Related U.S. Application Data

(60) Provisional application No. 60/573,409, filed on May 24, 2004.

(51) Int. Cl.
*H01J 49/00* (2006.01)

(52) U.S. Cl. ..... 250/292; 250/290; 250/396 R

(58) Field of Classification Search ..... 250/292, 250/290, 396 R
See application file for complete search history.

(56) References Cited

U.S. PATENT DOCUMENTS 5,179,278 A 1/1993 Douglas
5,763,878 A 6/1998 Franzen
6,093,929 A 7/2000 Javahery et al.
6,111,250 A 8/2000 Thomson et al.
6,707,037 B2 3/2004 Whitehouse
7,141,789 B2 * 11/2006 Douglas et al. ..... 250/292

* cited by examiner

*Primary Examiner*—Kiet T. Nguyen
(74) *Attorney, Agent, or Firm*—Bereskin & Parr

(57) ABSTRACT

The invention provides a multipole ion trap. The trap has a longitudinal axis. An oscillating on-axis potential is set up along the longitudinal axis, providing a potential well in which ions are trapped. In some embodiments, rods forming the poles are symmetrically and equidistantly positioned about the longitudinal axis and RF signal with different magnitudes are applied to the poles. In other embodiments, the rods are not positioned symmetrically about the longitudinal axis and the RF signals applied to the poles may have the same or different magnitudes. Poles used in the invention may include two or more rods. An ion trap according to the invention may include more than two poles, and in some embodiments, a third or additional pole may be added to provide the oscillating on-axis potential. The ion trap may be used mass selectively scan ions, fragment ions and to trap and separate differently charged ions, among other uses.

50 Claims, 12 Drawing Sheets

Frequency spectra for the ion motion along the z-axis.
The spectra were obtained using a 50 ms long ion trajectory.
10 V on the exit and entrance plates, 2000 V on
the parallel rods and 0 V on the tilted rods.

Frequency of ion motion along the z axis as a function of 1/(m/z).
9 mm long tilted rod LIT, 2000 V on the parallel rods
and 0 V on the tilted rods. 10 V on the entrance
and exit plates Frequency spectra for the ion motion along the y-axis.
The spectra were obtained using a 50 ms long ion trajectory.
10 V on the exit and entrance plates, 2000 V on
the parallel rods and 0 V on the tilted rods.

Frequency of ion motion along the y axis as a function of 1/(m/z).
9 mm long tilted rod LIT, 2000 V on the parallel rods
and 0 V on the tilted rods. 10 V on the entrance
and exit plates

SYSTEM AND METHOD FOR TRAPPING IONS

This application claims the benefit of U.S. provisional patent application 60/573,409, filed May 24, 2004, which is incorporated herein by this reference.

FIELD OF THE INVENTION

This invention relates to ion traps, and more specifically, it relates to a multipole elongated rod linear ion trap suitable for use in a mass spectrometer.

BACKGROUND OF THE INVENTION

A conventional linear ion trap typically includes two or more poles, each of which includes two or more rods. The rods in an ion trap collectively form a rod set or rod array. In a conventional linear ion trap, the rods are parallel to a longitudinal axis of the ion trap. The longitudinal axis lies along a Z-dimension. A plane normal to the Z-dimension lies on an X-Y plane, defined by orthogonal X and Y dimensions. In a linear ion trap with four rods, two opposing rods are typically defined as X pole rods and are spaced apart equidistant from the longitudinal axis in the X dimension. The X pole rods form an X pole. The other two opposing rods are typically defined as Y pole rods and a spaced apart equidistant from the longitudinal axis in the Y dimension. The Y pole rods form a Y pole.

To function as an ion trap, the parallel rod set is augmented with end caps or lenses that supply an axial trapping potential.

An RF potential is applied to the X and Y poles. Typically, the RF potential is equal in magnitude and frequency, but out of phase by 180°. The end caps provide fringing fields. Some ions, depending on the characteristics of the radial trapping potential, are trapped within the rod set, while others are radially ejected.

Ions are ejected, for the purposes of mass analysis, either radially, through one or more rods, or axially, through the process of mass selective axial ejection (MSAE). In the MSAE technique ions are first excited radially to a high fraction of the field radius, $r_0$ defined above, and then, through interaction with the fringing fields at the exit of the ion trap, are detected axially.

SUMMARY OF THE INVENTION

The present invention provides a linear ion trap that is suitable for use in an ion trap mass spectrometer or other types of spectroscopy.

A linear ion trap according to the invention includes at least two poles. Each pole includes two or more rods and the group of rods in all of the poles may be referred to as a pole array. The linear ion trap also has entrance and exit lenses positioned at the longitudinal ends of the linear ion. An oscillating on-axis potential is applied to the linear ion trap. The oscillating on-axis potential has a non-zero $2^{nd}$ derivative with time. In addition, DC potentials are applied to the entrance and exit lenses to provide fringing fields at the ends of the trap. Preferably, the length of the rods in the rod array is less than approximately 3 $r_0$, where $r_0$ is the spacing between the rods in the rod array and the longitudinal axis of the ion trap.

The existence of the non-zero $2^{nd}$ derivative of the on-axis potential with time along the longitudinal axis of the trap produces ion motion along the longitudinal axis of the trap.

Ions display frequencies of motion that are mass dependent along the longitudinal axis. Application of an excitation signal, such as dipolar excitation, to the exit lens provides for a means of scanning the ions longitudinally out of the trap. The frequency of the ion motion is dependent upon the magnitude of the oscillating on-axis potential generated in the ion trap and the DC potentials applied to the entrance and exit lenses. Ions can be scanned out of the trap by holding the frequency of the excitation signal constant and scanning the magnitude of the oscillating on-axis potential to bring the ion into resonance with the excitation signal frequency. Ions may also be scanned out of the trap by holding the magnitude of the oscillating on-axis potential constant while scanning the frequency of the excitation signal. Either technique will produce a mass spectrum.

A linear ion trap according to the invention allows an efficient extraction of ions through the exit lens. The extraction of ions in the direction of excitation provides for the possibility of high extraction efficiencies while scanning at high scan rates.

In one embodiment of the invention, the linear ion trap includes four rods that are parallel and equidistant from the longitudinal axis of the linear ion trap. Entrance and exit lenses are positioned adjacent the longitudinal ends of the ion trap.

The four rods are arranged in pairs into X and Y poles. One pair of rods are X pole rods and form the X pole. The other pair of rods are the Y pole rods and form the Y pole. The X pole rods are positioned on opposite sides of the longitudinal axis from one another and similarly the Y pole rods are also positioned on opposite sides of the longitudinal axis from one another. Adjacent rods in the rods array are equally spaced from one another.

An RF potential is applied to the X and Y poles to produce a radial trapping potential. The RF potential applied to the X poles is 180 degrees out of phase with the RF potential applied to the Y poles. DC potentials are applied to the entrance and exit lenses, which provide a means for trapping the ions along the longitudinal axis of the ion trap by providing a fixed DC potential at the location of the entrance and exit lenses. The entrance and exit lenses can be of large aperture with a grid covering the apertures to help define the ends of the trap.

The longitudinal axis of the linear ion trap defines a Z dimension. An X dimension is defined between the X pole rods and a Y dimension is defined between the Y pole rods.

An oscillating on-axis potential is created by applying unequal amplitudes of the RF potential to the X and Y poles. This causes an oscillating non-zero on-axis potential that oscillates at a frequency corresponding to the RF main drive frequency. The magnitude of the oscillating on-axis potential decreases as the entrance and exit lenses are approached because of the fringing fields provided by the entrance and exit lenses. The distance between the rods and the longitudinal center axis of the linear ion trap is $r_0$. The length of the rods in the rod array is preferably less than approximately 3 $r_0$, where $r_0$ is the spacing between the interior edge of each rod and the longitudinal axis of the ion trap. This provides for an oscillating on-axis potential that has a non-zero $2^{nd}$ derivative with time, at an RF amplitude of V volts, along the longitudinal length of the trap. The frequency or magnitude of the oscillating on-axis potential can be controlled by varying the frequency or magnitude of the RF potential applied to the poles.

In another embodiment of the invention, an oscillating on-axis potential is created by maintaining equal (but out of phase) RF potentials on the X and Y poles and tilting or misaligning one or more of the rods relative to the Z dimension. Entrance and exit lenses are still positioned at either end of the rod array and the overall length of the rods is preferably also maintained at less than approximately 3 $r_0$.

In another embodiment, one or more of the rods in the rod array may be tilted while also applying unequal amplitudes of the RF potential to the X and Y poles.

In another embodiment, a rod array may include two or more poles to which a balanced RF signal is applied. The oscillating on-axis potential is generated by a providing an additional pole (which may consist of one or more additional rods) and applying an RF signal to the additional pole. The additional RF signal generates an unbalanced potential in an X-Y plane normal to the Z dimension, thereby generating an oscillating on-axis potential. In other embodiments, two or more additional poles could be provided and unequal RF potentials could be applied to these poles.

An ion trap according to the invention may also be used to excite ions for the purposes of fragmentation. An ion trap according to the invention can be operated at pressures ranging from as low as $1\times10^{-5}$ Torr to several m Torr. Ions can be excited by providing an excitation signal to either the entrance lens, the exit lens or both lenses. The excitation signal can be dipolar or any other type of excitation that results in the ion gaining axial kinetic energy. Collisions of the ion with the background gas will result in fragmentation of the ion. Alternatively, ions can be excited by applying an excitation signal to one or more of the rods to produce radial excitation of the trapped ions. The excitation signal can be either dipolar, quadrupolar or any other type of excitation that results in the ion gaining radial kinetic energy. The increase in radial kinetic energy of the ion can lead to energetic collisions with the background gas resulting in fragmentation of the ion. The resulting fragmentation patterns from either radial or axial excitation can be used to aid in the identification of the excited ion.

These and other features of the present invention are further described in the description below of several exemplary embodiments of the invention.

BRIEF DESCRIPTION OF THE DRAWINGS

A preferred embodiment of the present invention will now be described in detail with reference to the drawings. In the drawings, like elements are identified by like reference numerals. In the drawings, the elements illustrated are not drawn to scale but are illustrative of the embodiments described. In the drawings.

DETAILED DESCRIPTION OF EXEMPLARY EMBODIMENTS

The exemplary linear ion traps described below include four rods organized into two poles. However, the invention is equally applicable to a linear ion trap with more than two poles or with poles that include more than two rods.

The linear ion traps described below include four rods which can be parallel or non-parallel to the longitudinal axis of the trap, in the Z dimension. One pair of opposing rods is designated the X pole and the second pair of opposing rods is designated can be called the Y pole. An RF potential is applied to the X and Y poles to produce a radial trapping potential as is well known in the art of quadruple theory. Entrance and exit lenses positioned adjacent the longitudinal ends of the rods provide a means for trapping ions along the longitudinal axis of the ion trap by providing a fixed potential at the location of the entrance and exit lenses. The entrance and exit lenses can be of large aperture with a grid covering the apertures to define the ends of the trap.

Figure 1:
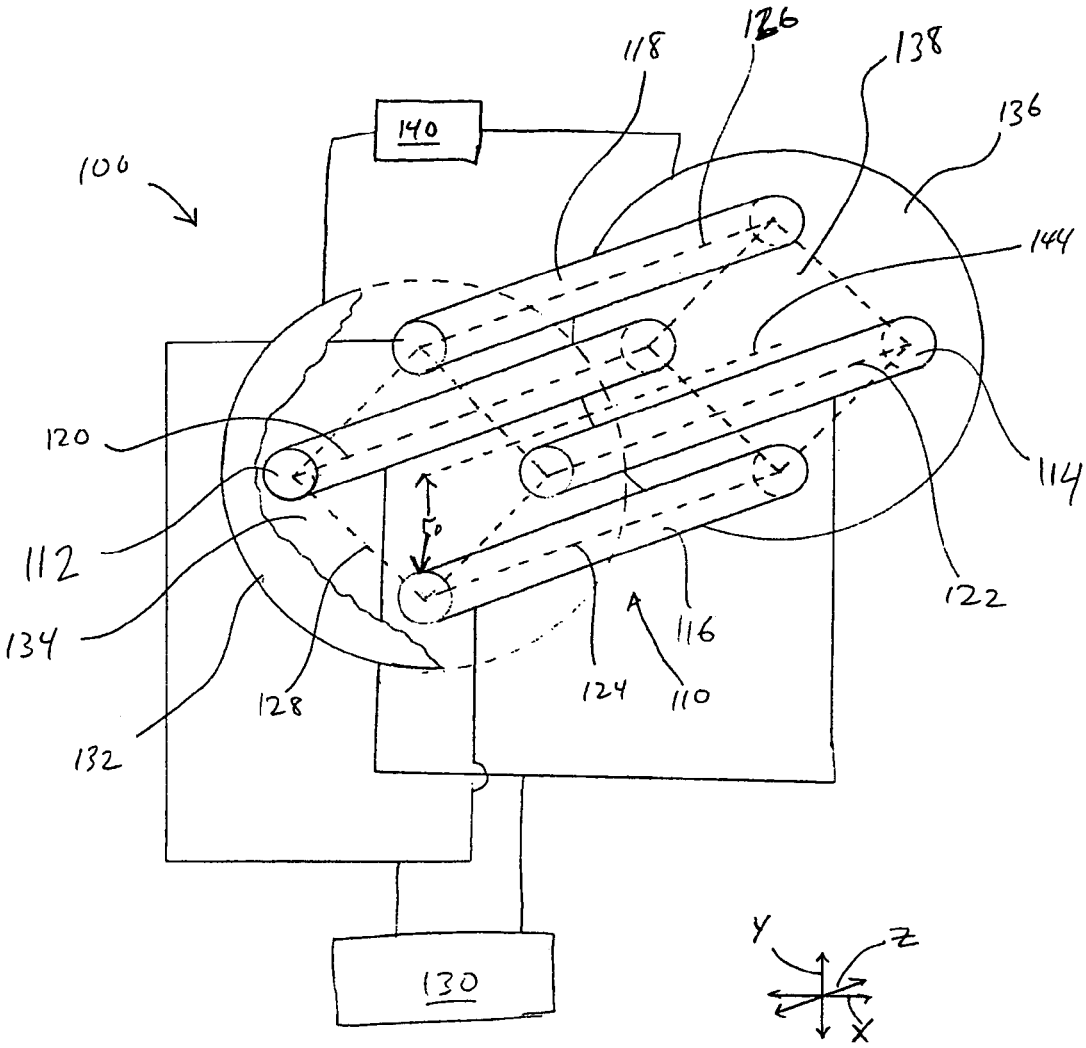
FIG. 1 illustrates a first ion trap according to the invention.

Reference is made to FIG. 1, which illustrates a first linear ion trap 100 according to the present invention. Trap 100 includes a rod set 110 including four conducting rods: 112, 114, 116 and 118 disposed relative to four parallel edges 120, 122, 124, and 126 of a nominal (i.e., fictitious) box 128.

A first pair of rods 112 and 114 lie on opposite edges 120 and 122 and form an X pole. The second pair of rods 116 and 118 lie on opposite edges 124 and 126 and form a Y pole. The rods 112, 114, 116 and 118 may be cylindrical or may have a hyperbolic cross section.

Ion trap 100 has a longitudinal axis 144. Rods 112, 114, 116 and 118 are spaced about equally from longitudinal axis by a distance $r_0$. The rods 112, 114, 116 and 118 are about 3 $r_0$ in length. Longitudinal axis 144 lies parallel to a Z-dimension. The X pole rods 112 and 114 define an X dimension and the Y pole rods 116 and 118 define a Y dimension. The Z, X and Y dimensions are illustrated in FIG. 1 and are orthogonal to one another.

Ion trap 100 also includes a power supply 130, a first end device 132 near one end 134 of the rod set 110, a second end device 136 near an opposite end 138 of the rod set 110, and an additional power supply 140. For example, the end devices 132 and 136 can be an end plate or lens. The first end device 132 can be an entrance device or an exit device. If the first end device 132 is an entrance device, then the second end device 136 is an exit device, and if the first end device 132 is an exit device, then the second end device 136 is an entrance device. End device 132 is shown cutaway and part of its perimeter is shown in dotted outline to allow other components of trap 100 to be better illustrated.

In the present embodiment, the first end device 132 is an entrance lens and has an 8 mm mesh covered aperture to allow ions to enter the rod set 110. The second end device 136 is an exit lens, which likewise has an 8 mm mesh covered aperture to allow ions to exit the rod set 110. By applying an excitation field to the end device 132, end device 136 or to both end devices 132 and 136, ions can be mass selectively ejected from the trap through an end device.

The power supply 130 applies a first voltage to the first pair of rods 112 and 114, and a second voltage to the second pair of rods 116 and 118. The application of the voltages to the set of four rods 12, 14, 16 and 18 results in a trapping potential inside the rod set 11 capable of trapping an ion therein.

The first voltage that is applied to the first pair of rods 112 and 114 is a first RF voltage and the second voltage that is applied to the second pair of rods 116 and 118 is a second RF voltage. The first and second voltages are out of phase by 180°. The first and second RF voltages may also include a common DC offset voltage.

In a conventional linear ion trap, the voltages applied to the poles may be described by the equation $\phi_0=U+V\cos(\Omega t)$ where U is the DC voltage, pole to ground and V is the zero to peak RF voltage, pole to ground. Typically, the phase of the RF potential applied to the Y pole is 180 degrees out of phase with the RF potential applied to the X pole, i.e. on the X pole the potential is described by $U_x+V_x\cos(\Omega t)$ and the potential to the Y pole by $U_y+V_y\cos(\Omega t+\delta)$ where $U_x$ and $U_y$, the DC potentials, may be zero or non-zero. $V_x$ and $V_y$ are the RF potentials as measured pole to ground. The main drive frequency of the linear ion trap is represented by Ω, and the 180 degree phase difference is represented by the variable δ. Time is represented by the variable t. The entrance lens 132 and the exit lens 136 provide a means for trapping ions along the longitudinal axis of the ion trap by providing a fixed potential on the longitudinal axis of the linear ion trap at the location of the entrance and exit lenses.

The additional power supply 140 applies a first end voltage to the first end device 132 and a second end voltage to the second end device 136.

In the present embodiment, an oscillating on-axis potential is created by applying unequal amplitudes of the RF potential to the X and Y poles, i.e. $V_x$ is not equal to $V_y$. This causes a non-zero on-axis potential which, for rods of length greater than about 3 $r_0$, has an amplitude equal to the absolute value of $(V_x-V_y)/2$ at the longitudinal centre of the ion trap and a frequency corresponding to the drive frequency, Ω. The magnitude of the on axis potential decreases as the entrance lens 132 and exit lens 136 are approached due to the fringing fields provided by the entrance and exit lenses. Preferably the overall length of the rods should be limited to less than about 3 $r_0$. This provides a non-zero $2^{nd}$ derivative of the on-axis potential along essentially or substantially the entire longitudinal axis of the trap and causes the ions to oscillate along the longitudinal axis of the ion trap. The length of the rods and the amount of unbalancing result in a potential well having a non-zero $2^{nd}$ derivative of one phase of the potential.

Trap lengths which result in a zero $2^{nd}$ order derivative along a region of the length of the trap will provide of a region in which the ions axial motion will be determined by thermal energies alone, i.e. the ions will not have an appreciable degree of oscillation parallel to or along the longitudinal axis. The magnitude of the on-axis potential is proportional to the magnitude of the difference in the RF potentials applied to the X and Y poles. The greater the magnitude of the difference is the higher the ions axial frequency of motion.

Figure 2:
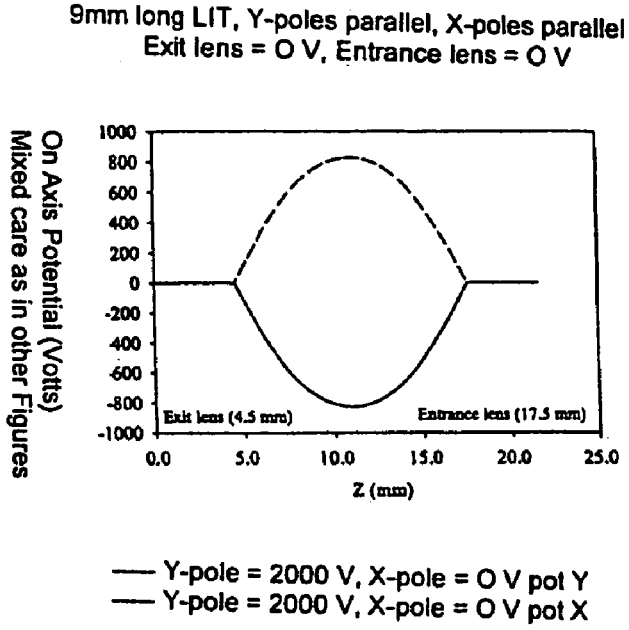
FIG. 2 illustrates an on-axis potential of an ion trap according to the invention.

FIG. 2 shows the on-axis potential for the case $V_x$=2000 V and $V_y$=0 V ($V_x$ is applied to the X pole and $V_y$ to the Y pole), at a drive frequency of 816 kHz, in a system similar to that of FIG. 1, but with a rod length equal to 2 $r_0$, where $r_0$ was set to 4.5 mm. The on-axis potential is shown for two different phases of $V_x$ separated by 180 degrees when $V_x$ is at its maximum and minimum. One phase is illustrated with a solid line and the other phase is illustrated with a dotted line. In each case the end devices have been held at a constant potential of 0 V.

Figure 3:
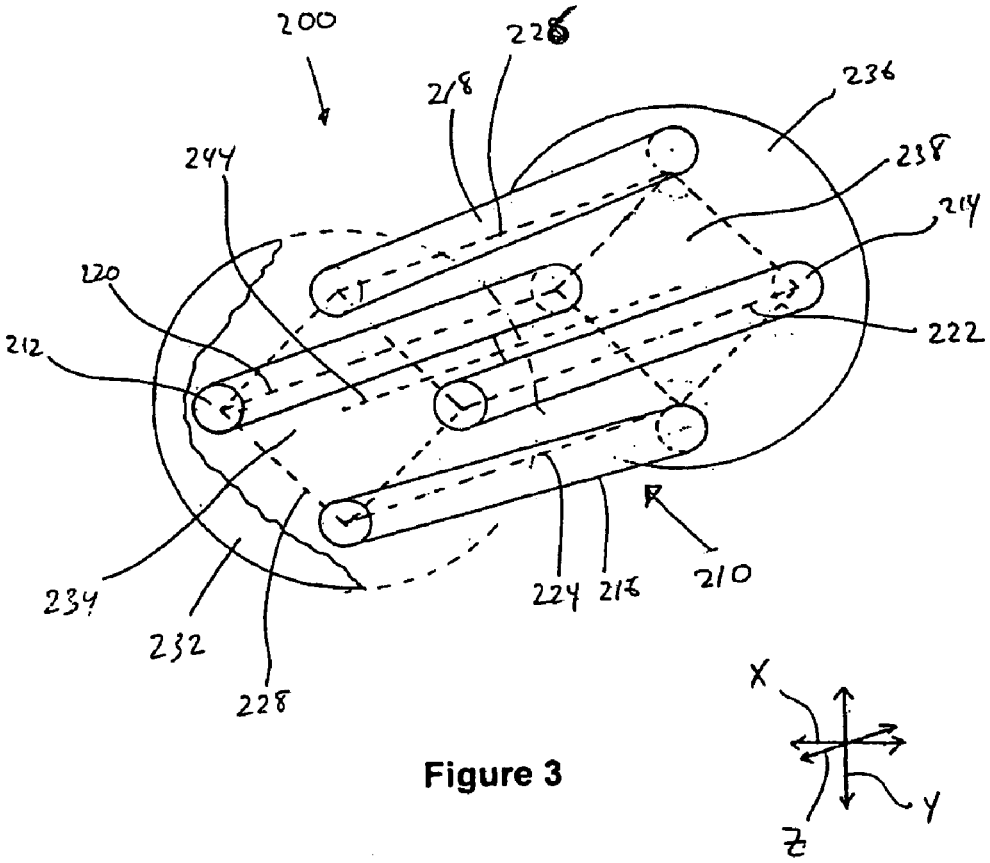
FIG. 3 illustrates a second ion trap according to the invention.

Reference is next made to FIG. 3, which illustrates a second linear ion trap 200 according to the invention. In FIG. 3, power supplies 230 and 240 and their connections to rod set 210 are not illustrated for clarity. Linear ion trap 200 includes an X pole formed of rods 212 and 214. Rods 212 and 214 are parallel to longitudinal axis 244 and are equally spaced apart from the longitudinal axis along their length. Rods 212 and 214 lie on edges 220 and 222 of a nominal box 228. Linear ion trap 200 also includes a Y pole formed of rods 216 and 218. Rods 216 and 218 are tilted or perturbed relative to the longitudinal axis 244. The axes of rods 216 and 218 are coplanar with edges 224 and 226 of nominal box 228. At the entrance end 234 of linear ion trap 200, the axis of rod 216 is coincident with edge 224. At the exit end 238, the axis of rod 216 is spaced further from longitudinal axis 244 than edge 224. Rod 218 is similarly tilted further away from the longitudinal axis 244 at the exit end of the linear ion trap than at the entrance end of the linear ion trap. In this exemplary embodiment, rods 216 and 218 are tilted at an angle of about 5°. Preferably, the tilt angle of the rods retains the q value for the rods between 0.1 and 0.8.

Power supply 230 (not shown) applies first RF voltage to the X pole and a second RF voltage to the Y pole. The first and second voltages are identical in magnitude and frequency, but are 180° out of phase, as described above in relation to the voltages applied to a conventional linear ion trap.

Power supply 240 (not shown) applies a first end voltage to the first end device 232 and a second end voltage to the second end device 236, generating fringing fields as described above.

The tilting or perturbation of the Y pole rods from a parallel position with respect to the longitudinal axis 244 results in an oscillating on-axis potential along the longitudinal axis 244. Ions are trapped in the variable oscillating on-axis potential created by the presence of higher order field distortions that arise because of the tilting of the rods. The higher field contributions can be described in terms of the multipole expansion $$\phi_n = \sum_{n=0} A_n \,\mathrm{Real}\left(\frac{x+iy}{r_0}\right)^n$$

where the number of rods is represented by the value 2n, i.e. for a quadruple n=2, an octopole n=4, etc. The on-axis potential is represented by the n=0 term. (For a general discussion of higher order field contributions see Douglas et al, *Tech. Phys.* 1999, 44, 1215-1219.)

$$n=0 \qquad \phi_0 = A_0$$

$$n=1 \qquad \phi_1 = \frac{A_1(x)}{r_0}$$

$$n=2 \qquad \phi_2 = \frac{A_2(x^2-y^2)}{r_0^2}$$

$$n=3 \qquad \phi_3 = \frac{A_3(x^3-3xy^2)}{r_0^3}$$

-continued $$n = 4 \qquad \phi_4 = \frac{A_4(x^4 - 6x^2y^2 + y^4)}{r_0^4}$$

$$\vdots$$

Table 1 shows the amplitudes of the higher order field contributions present in a rod set with the ratios $r_y/r_x$=1.00 and $r_y/r_x$=1.20, where $r_x$ and $r_y$ are the distances from the longitudinal z-axis of the ion trap to the rods lying on the horizontal X-axis, and vertical Y-axis, respectively. The radius of the rods in the example are 1.125 $r_x$. In Table 1 $V_x$ and $V_y$ are equal.

TABLE 1

Amplitudes of the higher order field components with rods having the ratio of $r_y/r_x$ = 1.00 and 1.20

| N | $A_n$ ($r_y/r_x$ = 1.00) | $A_n$ ($r_y/r_x$ = 1.20) |
|---|---|---|
| 0 | 0.00000 | 0.18596 |
| 2 | −1.00142 | −0.81452 |
| 4 | 0.00000 | −0.00019 |
| 6 | −0.00133 | −0.00334 |
| 8 | 0.00000 | −0.00208 |
| 10 | 0.00243 | 0.00115 |
| 12 | 0.00000 | −0.00030 |

It can be appreciated that the value of $r_y/r_x$ varies along the length of the trap from $r_y/r_x$=1 at one end of the rod set to $r_y/r_x \neq 1$ at the opposite end of the rod set. The amplitude of the n=0 component will vary along the length of the rod set and will, in addition, be influenced by the presence of the fringing fields at the ends of the rod set.

Table 2 shows a variation of the set-up used to calculate the data in Table 1. In particular, instead of applying a "balanced" RF potential to the first pair of rods 12 and 14 and the second pair 16 and 18 (i.e., equal amplitudes but 180 degree phase shift), the amplitude applied to the two pairs are different in the calculations for the field components shown in Table 2. The potential applied to the X pole is higher by 10% than the Y pole potential.

TABLE 2

Amplitudes of the higher order field components with rods having the ratios of $r_y/r_x$ = 1.00 and 1.20 and $V_x$ = 1.1 $V_y$

| n | $A_n$ ($r_y/r_x$ = 1.00) | $A_n$ ($r_y/r_x$ = 1.20) |
|---|---|---|
| 0 | −0.04999 | 0.14528 |
| 2 | −1.05149 | −0.85524 |
| 4 | −0.00001 | −0.00022 |
| 6 | −0.00140 | −0.00351 |
| 8 | 0.00000 | −0.00210 |
| 10 | 0.00255 | 0.00121 |
| 12 | 0.00000 | −0.00031 |

An oscillating on-axis potential can be created by tilting one or more rods in a number of ways, ranging from a configuration in which exactly three rods are parallel to a configuration in which rods are neither parallel nor coplanar. In these configurations the RF potentials, $V_x$ and $V_y$, applied to the X and Y poles can be either equal or unequal. Generally, a combination of unbalanced fields and tilted rods can also be used to give rise to an axial trapping potential.

Figure 4A:
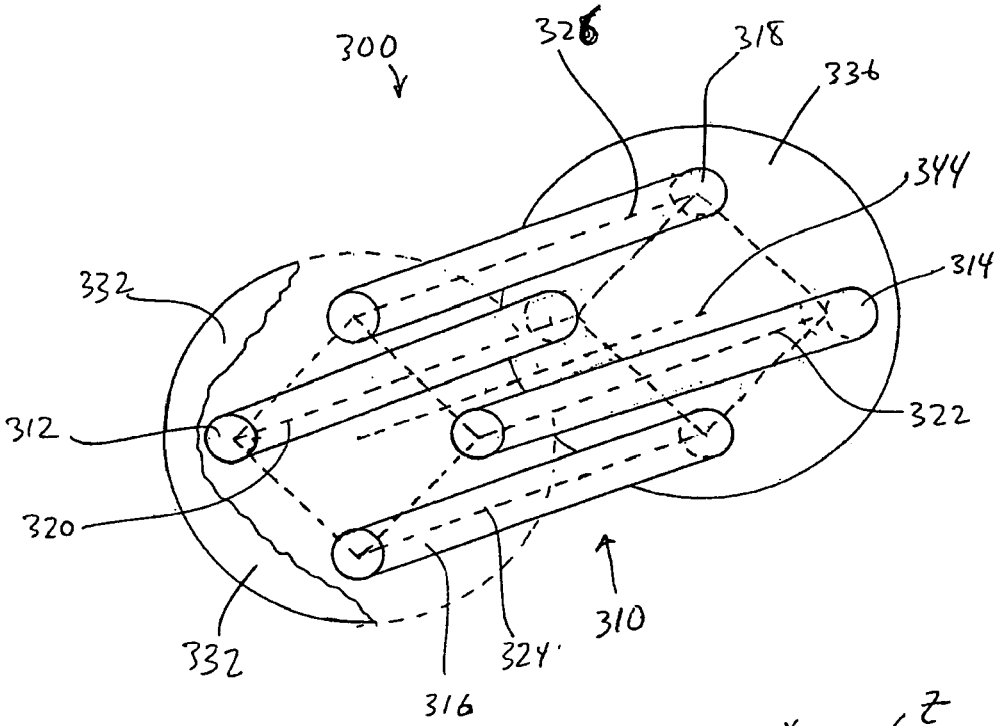
FIGS. 4A, 4B and 4C illustrate a third ion trap according to the invention.
Figure 4B:
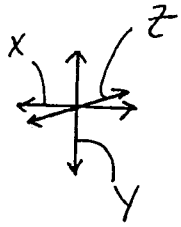
Figure 4B:
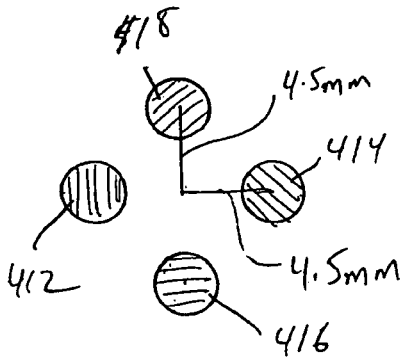
Figure 4C:
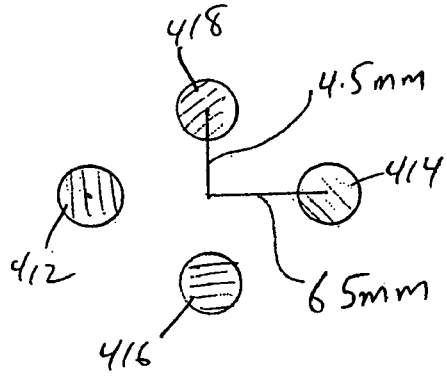

FIGS. 4A-C shows a tilted rod trap 300 that includes a rod set or array 310. Power supplies 330 and 340 are omitted for clarity. Rod set 310 includes four 26 mm long rods 312, 314, 316 and 318. In FIG. 2A, end plates 332 and 336 at either end 334 and 338 of the ion trap 300 are spaced 2 mm from the ends of the rods 312, 314, 316 and 318.

Rods 312 and 314 form an X pole and are tilted at 5 degrees relative to longitudinal axis 344. Rods 316 and 318 form a Y pole and are parallel to the longitudinal axis 344. FIG. 4B illustrates the cross section of rods 312-318 at end 334 of ion trap 300. FIG. 4C illustrates the cross section of rods 312-318 at end 338 of the ion trap 300.

The potential along the longitudinal Z axis 344 of the rod set 310 may be obtained by extracting the potential from the Simion™ modeling program which numerically calculates the potentials from inputted electrode geometry data.

Figure 5:
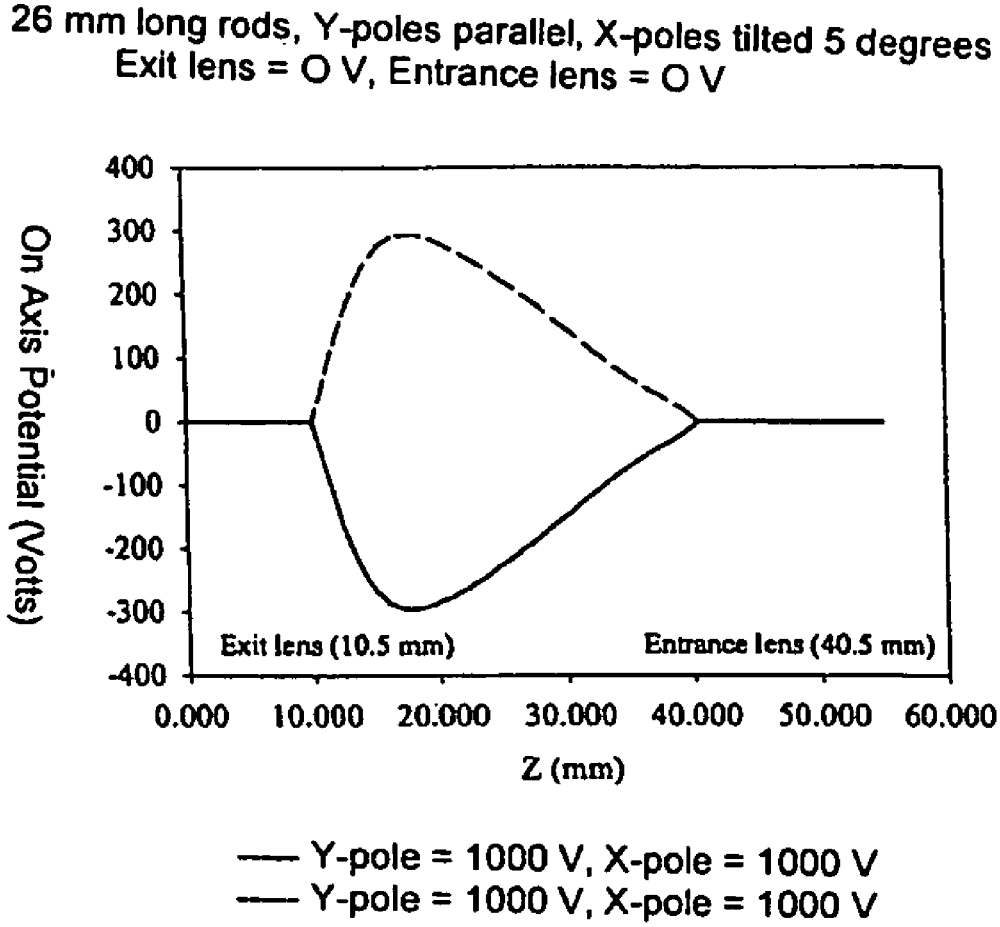
FIGS. 5, 6 and 7 illustrate the on-axis potential of the ion trap of FIG. 4 under different operating conditions.
Figure 6:
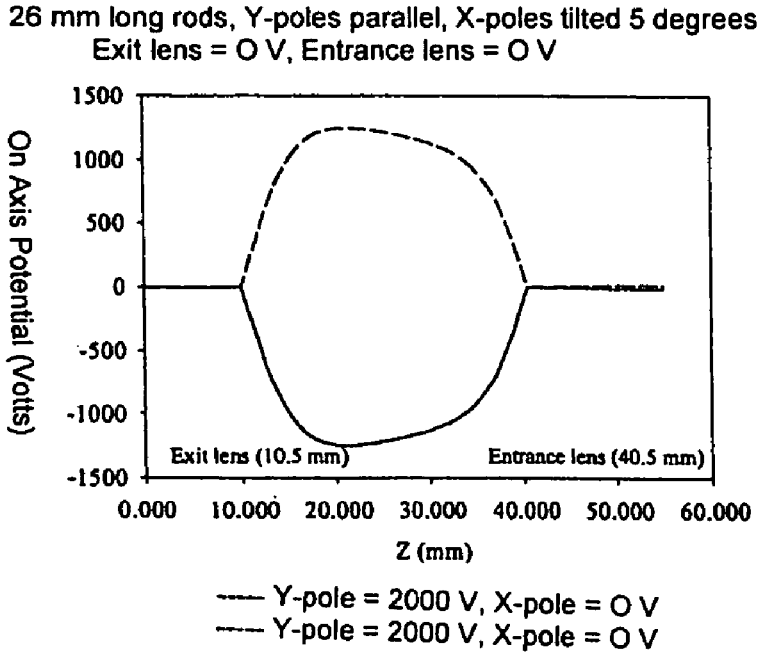
Figure 7:
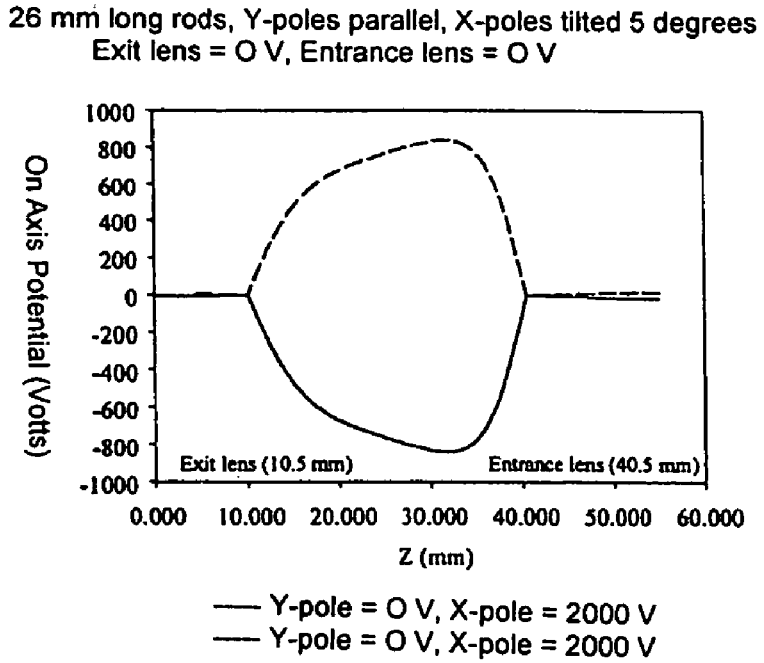

FIG. 5 shows the on-axis potential for the case of 0 V applied to the end plates 332 and 336 and ±1000 V to the X and Y pole pairs (i.e., a balanced application of RF fields to the two pairs). The on axis potential takes on an anharmonic shape with a maximum amplitude of about 300 V. Increasing the magnitude of the potential to 2000 V on the parallel rods and reducing the magnitude to 0 V on the tilted rods produces a potential well about four times deeper, as shown in FIG. 6. The potential still has an anharmonic shape. Applying the 2000 V magnitude to the tilted rods and 0 V to the parallel rods produces an anharmonic well with less depth, as shown in FIG. 7.

The length of the rods may be decreased to produce a well with a more harmonic shape and less width. A less broad well also produces higher frequencies of motion for the ion along the z-axis.

Two other rod lengths have been modelled, 12.5 and 9 mm, each with a minimum value of $r_0$=4.5 mm. In each case the angle of the tilted rod pair has been kept at 5 degrees. The choice of 5 degrees was arbitrary. Other angles could be considered for optimization. The optimum angle depends upon the desired well depth along the quadruple axis and the radial trapping potential required to keep ions within the rod set 11.

Figure 8:
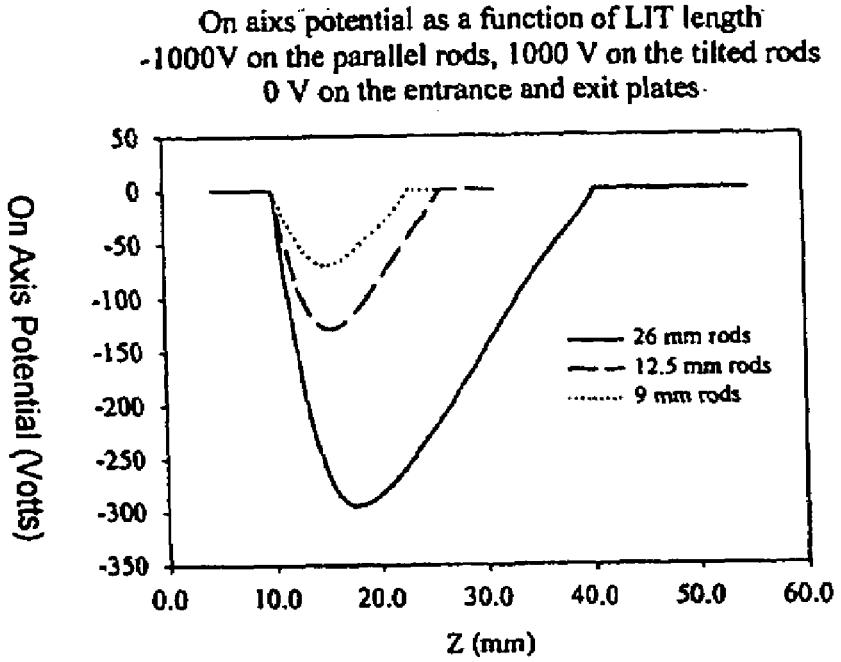
FIGS. 8 and 9 illustrate a comparison of the on-axis potential for several ion traps according to the invention.
Figure 9:
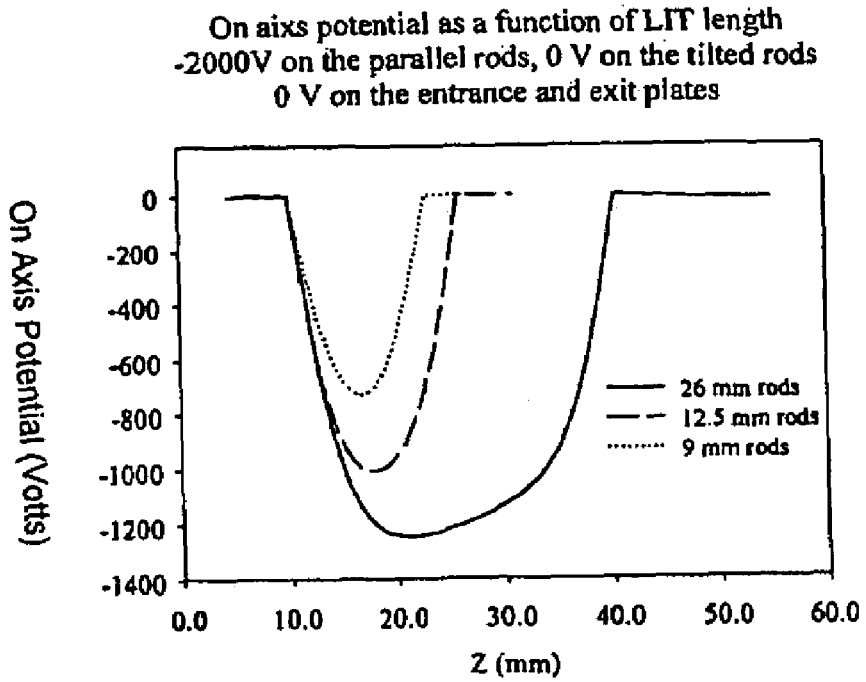

FIGS. 8 and 9 show a comparison of the on axis potentials for rod lengths 9, 12.5 and 26 mm with $r_0$=4.5 mm. The data is taken for the two cases. FIG. 8 illustrates the case of −1000 V on the parallel rods and 1000 V on the tilted rods. FIG. 9 illustrates the case of −2000 V on the parallel rods and 0 V on the tilted rods. The 9 mm length rods with 2000 V applied to the parallel rods and 0 V to the tilted rods yield the most harmonic shaped potential.

The potentials of the 9 mm long rod system were used to confine a number of ions with different masses within the rod set in different sets of simulations. The potential on the end plates was maintained at 10 V during the simulation. To study the frequency of ion motion, the ion of interest was started off within the ion trap system near the 'entrance' end of the system. The ion was started 0.5 mm off axis in both the X and Y directions with an energy of 1 eV in the direction of the 'exit' end at an angle of 10 degrees. The ion was allowed to cool for a period of 1 ms using mass 28 (nitrogen) as the collision partner. The mean free path during the cool period was 3 mm for m/z=1000, m/z=1100 and m/z=1500. It was 1 mm for m/z=2600. A mean free path of 3 mm corresponds to a pressure of 2 m Torr for an ion with a collision cross-section of 500 $Å^2$. After the cool period, the mean free path was changed to 10 mm, a pressure of 0.6 m Torr, for all masses. Ion trajectories were run for a period of 50 ms. Data was recorded every microsecond for the X, Y and Z coordinates. The frequency of the ion motion was obtained by performing a fast fourier transform (FFT) on this data. A 50 ms trajectory was used in order to reduce the minimum bandwidth of the ions motion to 20 Hz.

Figure 10:
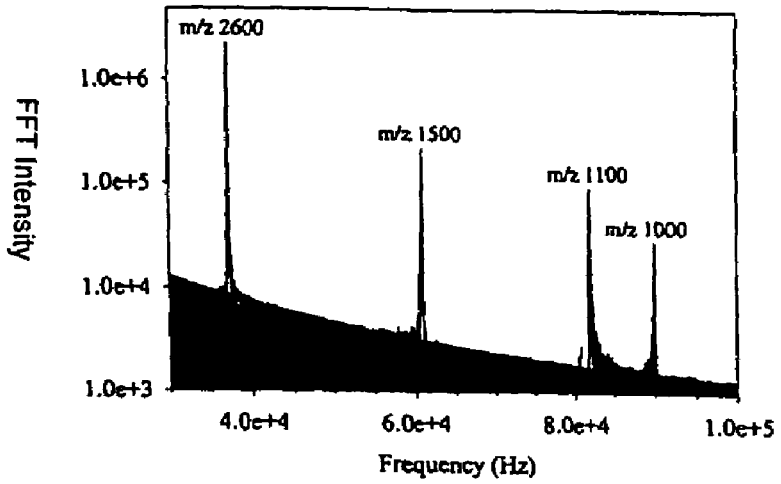
FIGS. 10 to 13 illustrate aspects of ion motion in exemplary ion traps according to the invention.

FIG. 10 shows the FFT results for the four masses. The FFT was taken using the data for the motion of the ion along the z axis. As expected, the data shows that the ion motion is a function of its mass. Heavier mass ions show the trend of lower frequency of motion than lighter mass ions. The frequencies are in the range of $10^4$ to $10^5$ Hz. It is expected that the ion motion may be described in a similar fashion to that used for 2-D and 3-D trapping potentials. All masses were held within the ion trap using the same trapping potentials in each case.

The secular frequency of an ions motion in a 2-D quadruple, at low Mathieu q is given by $$\omega_0 = q\frac{\Omega}{2\sqrt{2}}, \text{ where } q = \frac{4eV_{rf}}{mr_0^2\Omega^2}.$$

Figure 11:
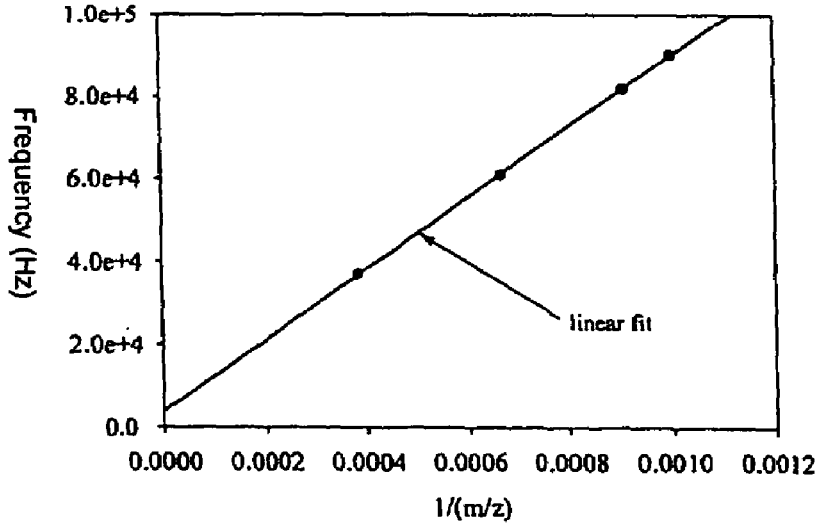

At constant $V_{rf}$, $\Omega$ and $r_0$ (the length of the rod set 11), q is proportional to 1/m. FIG. 11 shows that plotting the frequencies of ion motion from FIG. 10 as a function of 1/m does produce a straight line.

Figure 12:
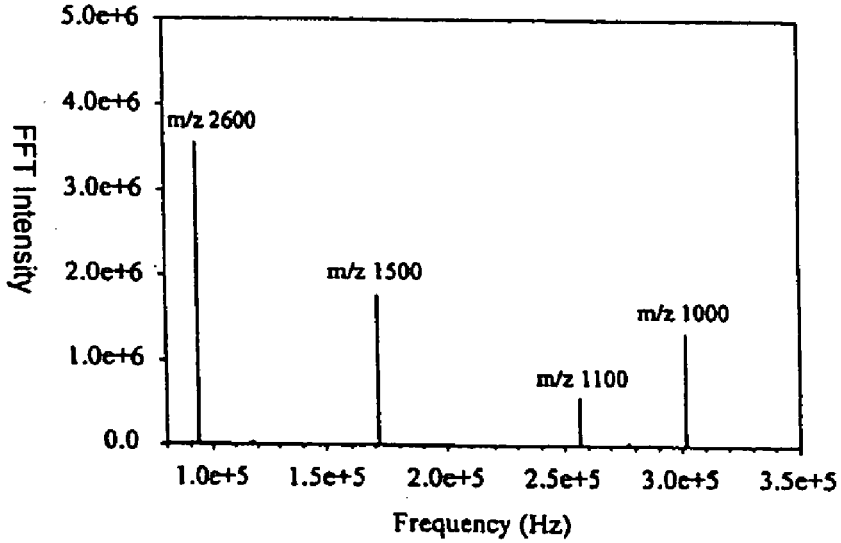
Figure 13:
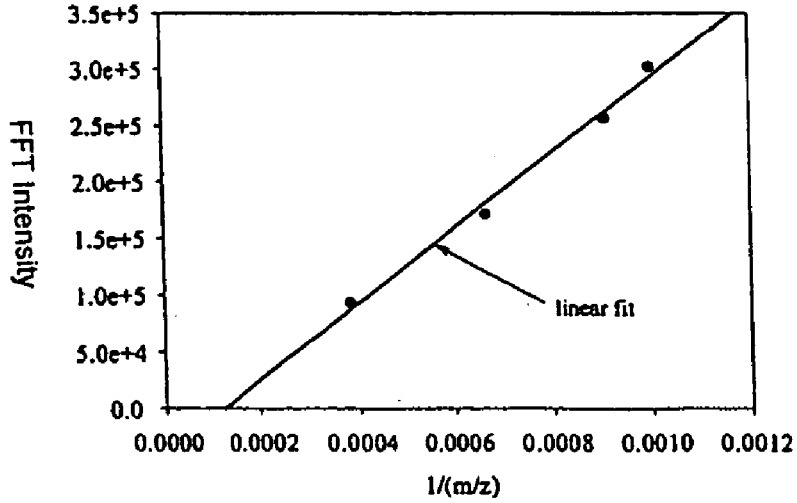

In addition to the discrete frequencies shown in FIGS. 10 and 11 for motion along the z-axis, the discrete frequencies are shown for motion along the Y-axis in FIGS. 12 and 13. Once again the frequency of ion motion is mass dependent; however, as is shown in FIG. 13, the dependency on mass is not quite linear.

The fact that ions of different masses have different frequencies of motion along the z-axis affords the opportunity for scanning the ions out of the ion trap 300. To scan the ions out, a dipolar signal can be applied to one of the end devices 332 or 336 when such a device is an aperture or a meshed aperture. To scan the ions out of the trap, one can scan the drive RF amplitude to bring the ions into resonance with a signal applied to the exit lens. Alternatively, the drive RF amplitude is held constant and the signal applied to the exit device is then scanned in frequency.

In addition to scanning, the opportunity exists for selectively fragmenting ions in either the X, Y or Z directions since the frequency of ion motion scales with the mass of the ion in some fashion and the fragment ions are capable of being contained within the rod set 310. The simultaneous trapping of a wide range of masses was demonstrated by the data of FIG. 10 where the masses m/z=1000 to m/z=2600 were trapped using the same trapping conditions.

Figure 14:
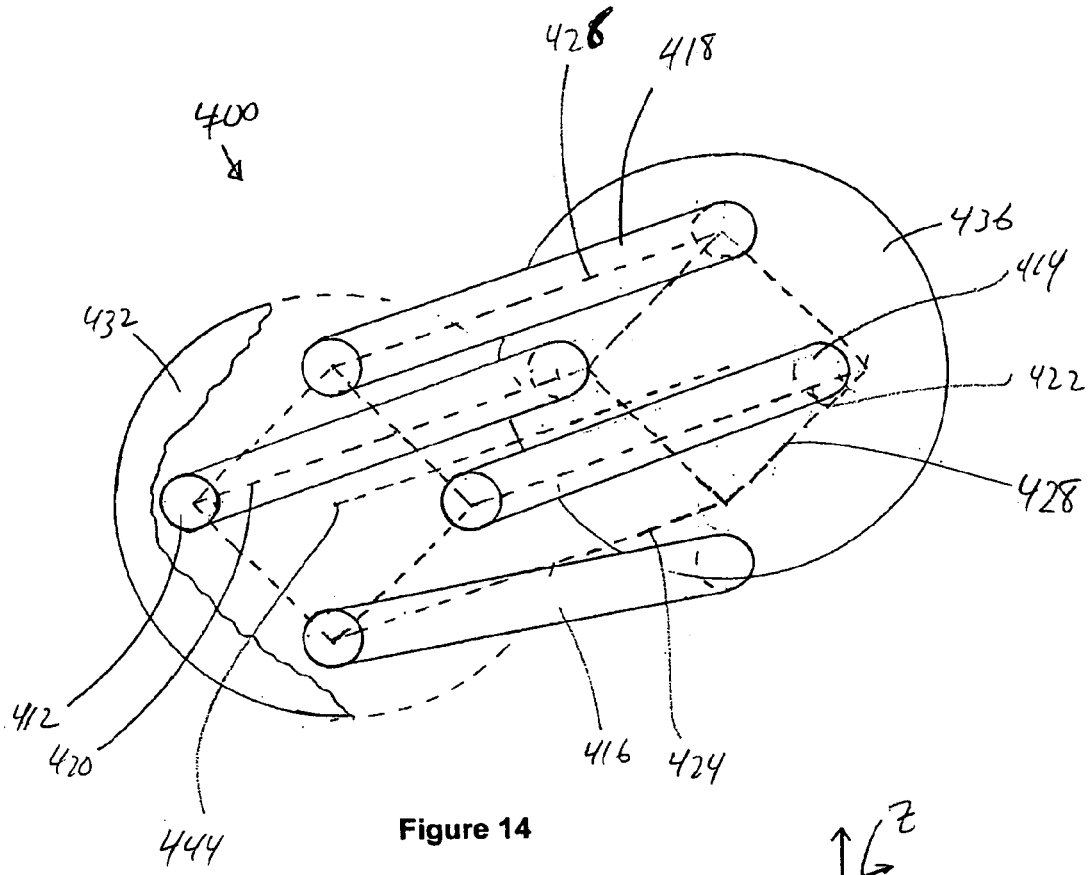
FIG. 14 illustrates a fourth ion trap according to the invention.

Reference is next made to FIG. 14, which illustrates a tilted rod ion trap 400 according to the invention. Power supplies 430 and 440 and their connections to the ion trap are not shown for clarity. Ion trap 400 system includes a rod set 410 of four rods 412, 414, 416 and 418 surrounding a longitudinal Z axis 444. Each of the four rods 412, 414, 416 and 418 points in a direction that is generally, but not precisely, parallel to longitudinal axis 444. A rod is considered to be generally parallel to the longitudinal Z axis 444 if, when the rods are considered to be vectors having a direction and magnitude, then the largest component of the vectors is the Z component (as compared to the X and Y components in the X and Y dimensions). No two rods of the rod set 410 are parallel, nor are any of the rods coplanar. In addition, no two centers of each of the four rods 412, 414, 416 and 418 at the second end 438 are equidistant to the longitudinal axis 420. (More generally, the centers of the rods at the first end 434 can also be non-equidistant.) End devices 432 and 436 are located at the ends of the rod set.

A power supply 430 applies a first voltage to the X pole rods 412 and 414 and a second voltage to the Y pole rods 116 and 118 of the rod set 410. As a result of the non-parallel and non-equidistant rods, the application of the voltages gives rise to an oscillating on-axis potential inside the set capable of trapping an ion therein. A power supply 440 also supplies DC voltages to the end devices to produce fringing fields at the ends 334 and 338 of the rod set.

Figure 15:
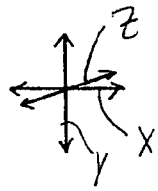
FIG. 15 illustrates, in cross section, the arrangement of rods in another embodiment of the invention.
Figure 15:
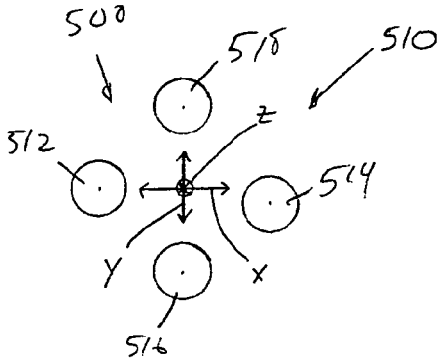

Reference is next made to FIG. 15, which illustrates a rod set 510 in cross section according to another embodiment of the invention. In rod set 510, an X pole is formed by rods 512 and 514 and a Y pole is formed by rods 516 and 518. X pole rod 514 has been shifted in the Y dimension from the condition illustrated in FIG. 1. All of the rods are parallel to the longitudinal Z axis 544 of the rod set, which is normal to the X-Y plane on which the cross-section of FIG. 15 is taken. End devices 532 and 536 (not shown) are located at the ends of the rod set. Power supplies 530 and 540 (not shown) are used to provide RF and DC signals to the rods and the end devices.

For example, rod 514 may be shifted by 2.5 mm. In other embodiments, rod 514 may be shifted by a larger or smaller amount.

Figure 16:
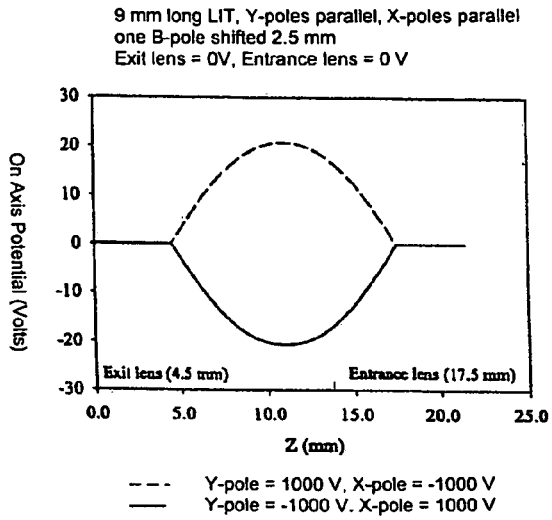
FIGS. 16 to 18 illustrate the on-axis potential for other embodiments of the invention.

In FIG. 16 the on-axis potential for rod set 510 is shown for two different phases of $V_x$ separated by 180 degrees when $V_x$ is at its maximum and minimum.

Ion traps 100-500 illustrate several exemplary configurations of an ion trap according to the present invention. Numerous other configurations are possible.

Figure 17:
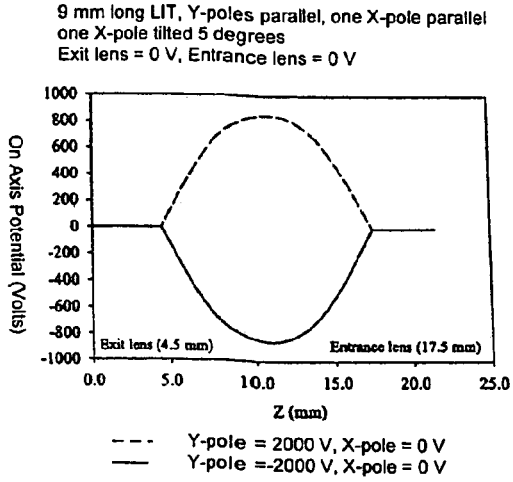

For example, FIG. 17 illustrates the on-axis potential for another quadruple ion trap according to the invention. The rods in the ion trap are 9 mm long and an end device is positioned 2 mm from each end of the rods. A pair of X pole rods and one Y pole rod are parallel to and co-planar with the longitudinal axis of the ion trap. The other Y pole rod is co-planer with the longitudinal axis but has been tilted 5° relative to the longitudinal axis. The following voltages are applied to the end devices and the poles:

(a) a DC voltage of 0 V is applied to each of the end devices;

(b) a RF voltage $V_x$ with a magnitude of 2000 V is applied to the X pole; and (c) a voltage $V_y$ of 0 V is applied to the Y pole.

Figure 18:
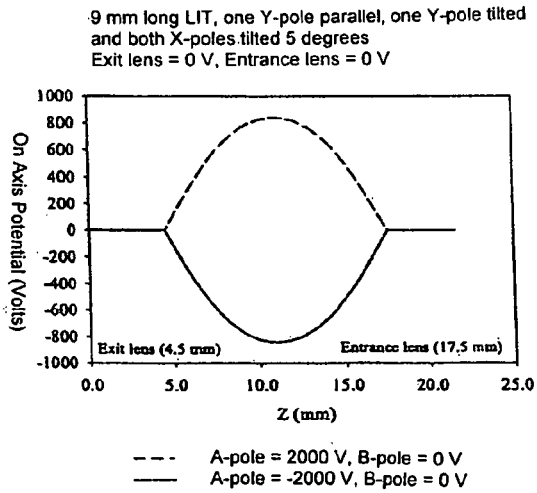

As another example, the FIG. 18 illustrates the on-axis potential for another quadruple ion trap according to the invention. The rods are 9 mm long and a pair of end devices are positioned 2 mm from the ends of the rods. One X pole rod is parallel to and co-planar with the longitudinal axis of the ion trap. The other X pole rod and the Y pole rods are co-planar with the longitudinal axis but have been titled 5° relative to the longitudinal axis. The following voltages are applied to the end devices and the poles:

(a) a DC voltage of 0 V is applied to each of the end devices;

(b) a RF voltage $V_x$ with a magnitude of 2000 V is applied to the X pole; and (c) a voltage $V_y$ of 0 V is applied to the Y pole.

Figure 19A:
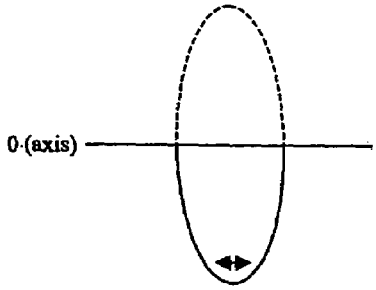
FIGS. 19A to 19C and 20A to 20C illustrate the on-axis potential and the first and second derivative of the on-axis potential for two ion trap ion traps.
Figure 20A:
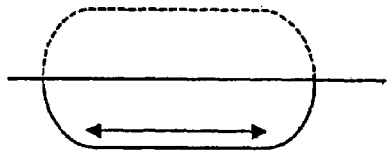
Figure 19B:
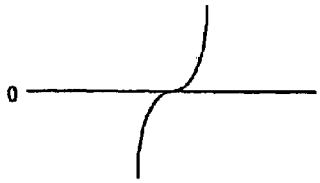
Figure 20B:
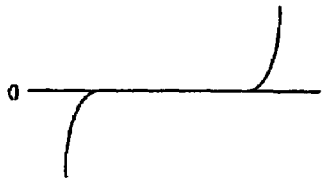
Figure 19C:
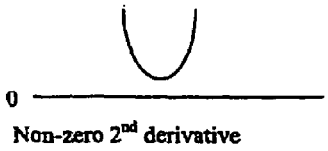
Figure 20C:
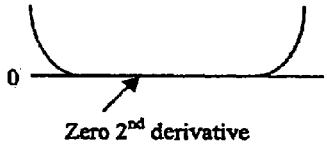

Reference is next made to FIGS. 19 and 20. As described, it is preferable that the rods in an ion trap according to the invention have a length that provides a potential well with an on-axis potential that has an essentially non-zero second derivative with time along the entire length of the rods. FIG. 19A shows an advantageous narrow well trapping potential, whereas FIG. 20A shows a less advantageous wider potential. FIGS. 19B and 20B plot their respective first derivatives, and FIGS. 19C and 20C plot their respective second derivatives. FIG. 19 corresponds to a rod set with a sufficiently short length that the desirable condition of a non-zero second derivative of the on-axis potential is essentially non-zero along the entire length of the rods. FIG. 20 corresponds to a rod set that is too long to provide this condition and has a zero second derivative over a relatively large range.

Reference is next made to FIG. 21, which illustrates that ions of either polarity can be trapped within an ion trap according to the present invention. Ions can be injected into the ion trap with the end devices held at 0 V potential. The ions' kinetic energy can be reduced sufficiently through collisions with a background gas to allow the ion to become trapped by the oscillating on-axis potential. Either positive or negative ions can be trapped using the same trapping conditions.

For example, positive ions can first be injected into the ion trap with the exit end device held at potential high enough to prevent ions from escaping through the exit. After cooling the positive ions will reside in the central portion of the ion trap. The potential on the exit end device can now be lowered to a negative potential. Negative ions injected into the ion trap will now be prevented from exiting the ion trap by the negative potential on the exit end device. After cooling the potential on the exit end device can be returned to 0 V. This affords the opportunity of using the ion trap for positive-negative ion reaction chemistry, neutralization experiments, etc.

Figure 21A:
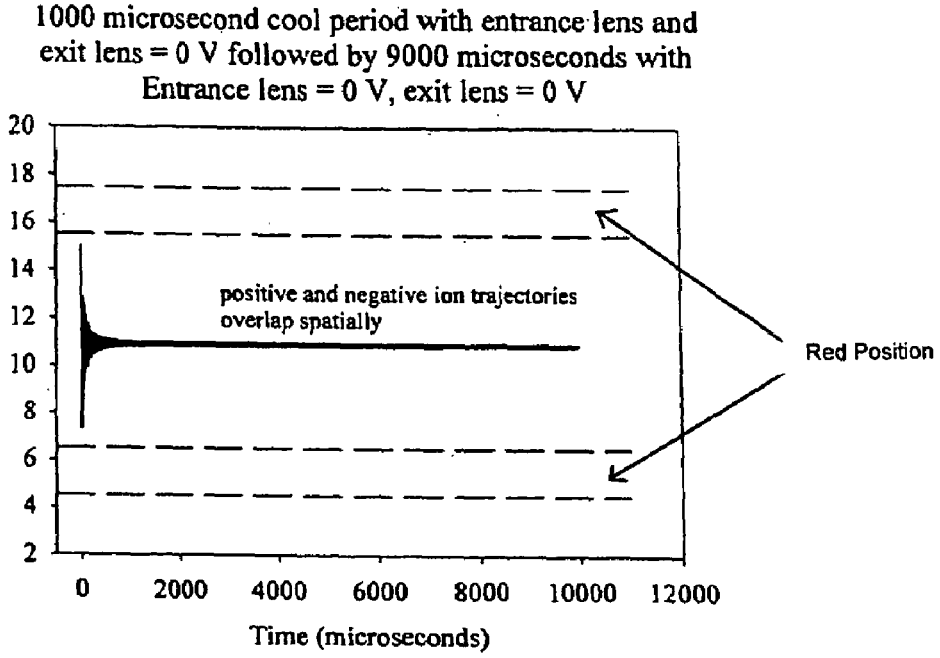
FIGS. 21A and 21B illustrate the separation of differently charged ion in an ion trap according to the invention.
Figure 21B:
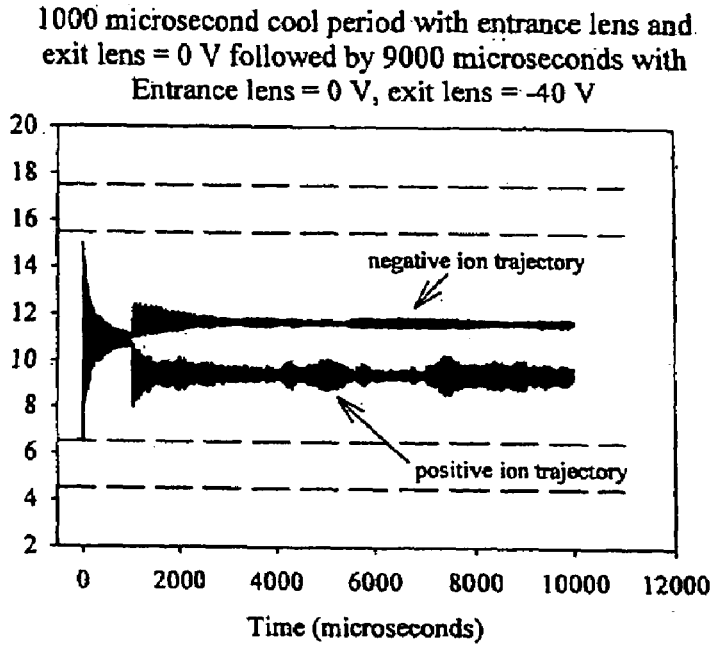

Applying a negative potential to the exit end device will cause positive ions to shift spatially along the longitudinal axis towards the exit end of the ion trap whereas negative ions will shift spatially towards the entrance end of the trap. This is demonstrated by the ion trajectories shown in FIGS. 21A and 21B. In FIG. 21A a pair of ions, one m/z=−1500 and the other m/z=+1500 are started within the ion trap near the entrance end of the trap. The trap consists of four parallel rods each 9 mm in length. The entrance and exit lens (end devices) are spaced 2 mm from the ends of the rods. RF potentials $V_x$=2000 V and $V_y$=0 V oscillating at 816 kHz. The DC offset potential applied to the rods is set equal to 0 V. Both ions are started at the same time with the same initial conditions apart from the difference in the polarity of the in charges. During the first 1000 microseconds of the ion trajectories the potentials on the entrance and exit lenses are set to 0 V. From 1000 to 10000 microseconds the potential on the exit lens, located at z=4.5 mm, is set to 0 V in FIG. 21A and to −40 V in FIG. 21B. The entrance lens is set to 0 V during this time. With the potential set to 0 V the ion trajectories for the positive and negative ions occupy the same spatial coordinates. When the potential on the exit lens is made −40 V the positive ion is attracted towards the exit lens while the negative ion is repelled by the exit lens. This provides for the possibility of separating the positive and negative ions spatially which in turn leads to the ability to turn a positive-negative ion reaction on or off. The possibility for studying kinetics can then be realized.

The foregoing embodiments of the present invention are meant to be exemplary and not limiting or exhaustive. The invention has general applicability to instruments with a variety of multipole rod sets including the quadruple rods sets described. While the term "rod sets" is used, it is to be understood that each "rod" can have any profile suitable for its intended function and has, at least a conductive exterior. Rods that are circular or hyperbolic are preferred. The scope of the present invention is only to be limited by the following claims.

I claim:

1. A linear ion trap comprising:

(a) a rod array having a first end and a second end and including a first pole and a second pole, wherein the first pole includes at least two first pole rods and the second pole includes at least two second pole rods;

(b) a first end device positioned adjacent the first end of the rod array;

(c) a second end device positioned adjacent the second end of the rod array;

(d) a first power supply for providing a first RF voltage to the first pole and a second RF voltage to the second pole;

(e) a second power supply for providing a first DC voltage to the first end device and a second DC voltage to the second end device, wherein the rod array has a longitudinal axis and wherein the first pole rods and the second pole rods are positioned generally parallel to the longitudinal axis and wherein the positions of the first and second pole rods and the first and second RF voltages cooperate to provide an oscillating on-axis potential along the longitudinal axis.

2. The linear ion trap of claim 1 wherein the oscillating on-axis potential has a non-zero second derivative along essentially the entire length of the rod array.

3. The linear ion trap of claim 2 wherein the first pole rods and the second pole rods are parallel to the longitudinal axis and wherein the first and second RF voltages have a different magnitude.

4. The linear ion trap of claim 2 wherein the first pole rods lie on a first plane and wherein the second pole rods lie on a second plane and wherein the first and second planes are orthogonal to one another.

5. The linear ion trap of claim 2 including equally spacing the first pole rods from the longitudinal axis by a first distance $r_1$ and equally spacing the second pole rods from the longitudinal axis by a second distance $r_2$.

6. The linear ion trap of claim 5 wherein the first pole rods and second pole rods have a length of less than about 3 $r_1$.

7. The linear ion trap of claim 5 wherein the first and second distances are equal.

8. The linear ion trap of claim 7 wherein the first pole rods and second pole rods have a length of less than about 3 $r_1$.

9. The linear ion trap of claim 2 wherein at least one of the first pole rods and the second pole rods is positioned along a line that is not parallel to the longitudinal axis.

10. The linear ion trap of claim 9 wherein the first pole rods are symmetrically perturbed relative to the longitudinal axis.

11. The linear ion trap of claim 9 wherein the first pole rods are asymmetrically perturbed relative to the longitudinal axis.

12. The linear ion trap of claim 9 wherein each of first and second pole rods are differently perturbed relative to the longitudinal axis.

13. The linear ion trap of claim 9 wherein the first pole rods and the second pole rods are spaced from the longitudinal axis by an average distance of $r_0$.

14. The linear ion trap of claim 13 wherein the first pole rods and second pole rods have a length of less than about 3 $r_0$.

15. A method of operating an ion trap comprising:

(a) providing a rod array including at least two first pole rods forming a first pole and at least two second pole rods forming a second pole;

(b) providing a first end device adjacent a first end of the rod array;

(c) providing a second end device adjacent a second end of the rod array;

(d) applying a first DC voltage to the first end device to provide a first fringing field adjacent the first end of the rod array;

(e) applying a second DC voltage to the second end device to provide a second fringing field adjacent the second end of the rod array; and (f) applying a first RF signal to the first pole and a second RF signal to the second pole to provide an oscillating on-axis potential along a longitudinal axis of the ion trap, wherein the first and second RF signals are 180° out of phase.

16. The method of claim 15 including scanning ions out of the ion trap by scanning the magnitude of the on-axis potential.

17. The method of claim 15 including scanning ions out of the ion trap by holding the frequency of the on-axis potential and applying an excitation signal to the first and second end devices and scanning the frequency of the excitation signal.

18. The method of claim 15 including fragmenting ions in the radial ion trap by applying an excitation signal to at least one of the first and second end devices to excite the ions and allowing the excited ions to collide with a background gas.

19. The method of claim 15 including simultaneously trapping positively charged ions and negatively charged ions in the ion trap by first trapping ions of one polarity and then trapping ions of the other polarity.

20. The method of claim 19 wherein the potential on the first and second end devices is changed between trapping ions of the one polarity and trapping ions of the other polarity.

21. The method of claim 15 wherein the oscillating on-axis potential has a non-zero second derivative along essentially the entire length of the rod array.

22. The method of claim 21 including positioning the first pole rods parallel to the longitudinal axis and positioning the second pole rods parallel to the longitudinal axis and wherein the first and second RF signals have a different magnitude.

23. The method of claim 22 including scanning ions out of the ion trap by scanning the magnitude of the on-axis potential.

24. The method of claim 22 including scanning ions out of the ion trap by holding the frequency of the on-axis potential and applying an excitation signal to the first and second end devices and scanning the frequency of the excitation signal.

25. The method of claim 22 including fragmenting ions in the radial ion trap by applying an excitation signal to at least one of the first and second end devices to excite the ions and allowing the excited ions to collide with a background gas.

26. The method of claim 22 including simultaneously trapping positively charged ions and negatively charged ions in the ion trap by first trapping ions of one polarity and then trapping ions of the other polarity.

27. The method of claim 26 wherein the potential on the first and second end devices is changed between trapping ions of the one polarity and trapping ions of the other polarity.

28. The method of claim 22 wherein the first pole rods lie on a first plane and wherein the second pole rods lie on a second plane and wherein the first and second planes are orthogonal to one another.

29. The method of claim 21 including equally spacing the first pole rods from the longitudinal axis by a first distance $r_1$ and equally spacing the second pole rods from the longitudinal axis by a second distance $r_2$.

30. The method of claim 29 wherein the first pole rods and second pole rods have a length of less than about 3 $r_1$.

31. The method of claim 29 wherein the first and second distances are equal.

32. The method of claim 31 wherein the first pole rods and second pole rods have a length of less than about 3 $r_1$.

33. The method of claim 21 including positioning the first pole rods and the second pole rods generally parallel to the longitudinal axis.

34. The method of claim 33 wherein the first and second RF signals have a different magnitude.

35. The method of claim 33 wherein the first and second RF signals have the same magnitude.

36. The method of claim 33 wherein at least one of the first pole rods and the second pole rods is positioned along a line that is not parallel to the longitudinal axis.

37. The method of claim 36 wherein the first pole rods and the second pole rods are spaced from the longitudinal axis by a minimum distance of $r_0$.

38. The method of claim 37 wherein the first pole rods and second pole rods have a length of less than about 3 $r_0$.

39. The method of claim 38 wherein the first and second RF signals have a different magnitude.

40. The method of claim 39 including scanning ions out of the ion trap by scanning the magnitude of the on-axis potential.

41. The method of claim 39 including scanning ions out of the ion trap by holding the frequency of the on-axis potential and applying an excitation signal to the first and second end devices and scanning the frequency of the excitation signal.

42. The method of claim 39 including fragmenting ions in the radial ion trap by applying an excitation signal to at least one of the first and second end devices to excite the ions and allowing the excited ions to collide with a background gas.

43. The method of claim 39 including simultaneously trapping positively charged ions and negatively charged ions in the ion trap by first trapping ions of one polarity and then trapping ions of the other polarity.

44. The method of claim 43 wherein the potential on the first and second end devices is changed between trapping ions of the one polarity and trapping ions of the other polarity.

45. The method of claim 38 wherein the first and second RF signals have the same magnitude.

46. The method of claim 45 including scanning ions out of the ion trap by scanning the magnitude of the on-axis potential.

47. The method of claim 45 including scanning ions out of the ion trap by holding the frequency of the on-axis potential and applying an excitation signal to the first and second end devices and by and scanning the frequency of the excitation signal.

48. The method of claim 45 including fragmenting ions in the radial ion trap by applying an excitation signal to at least one of the first and second end devices to excite the ions and allowing the excited ions to collide with a background gas.

49. The method of claim 45 including simultaneously trapping positively charged ions and negatively charged ions in the ion trap by first trapping ions of one polarity and then trapping ions of the other polarity.

50. The method of claim 49 wherein the potential on the first and second end devices is changed between trapping ions of the one polarity and trapping ions of the other polarity.

* * * * *